US008844456B2

(12) United States Patent
Lambrakos et al.

(10) Patent No.: US 8,844,456 B2
(45) Date of Patent: Sep. 30, 2014

(54) HEAVE STABILIZED BARGE SYSTEM FOR FLOATOVER TOPSIDES INSTALLATION

(75) Inventors: Kostas Filoktitis Lambrakos, Houston, TX (US); Bonjun Koo, Katy, TX (US); James O'Sullivan, Houston, TX (US)

(73) Assignee: Technip France, Courbevoie (FR)

( * ) Notice: Subject to any disclaimer, the term of this patent is extended or adjusted under 35 U.S.C. 154(b) by 327 days.

(21) Appl. No.: 13/392,488

(22) PCT Filed: Aug. 25, 2010

(86) PCT No.: PCT/US2010/046617

§ 371 (c)(1),
(2), (4) Date: Mar. 12, 2012

(87) PCT Pub. No.: WO2011/028568

PCT Pub. Date: Mar. 10, 2011

(65) Prior Publication Data

US 2012/0167813 A1 Jul. 5, 2012

Related U.S. Application Data

(60) Provisional application No. 61/236,935, filed on Aug. 26, 2009.

(51) Int. Cl.

| | |
|---|---|
| ***B63B 1/00*** | (2006.01) |
| ***B63B 9/06*** | (2006.01) |
| ***B63B 35/00*** | (2006.01) |
| *B63B 39/06* | (2006.01) |

(52) U.S. Cl.

CPC ..... *B63B 9/065* (2013.01); *B63B 2039/067* (2013.01); *B63B 39/06* (2013.01); *B63B 35/003* (2013.01)

USPC ..... 114/61.1

(58) Field of Classification Search

USPC ..... 114/256–267, 49–53, 61.1, 61.12, 114/61.22; 405/200, 203, 224

See application file for complete search history.

(56) References Cited

U.S. PATENT DOCUMENTS

| | | | | |
|---|---|---|---|---|
| 7,871,222 | B2 * | 1/2011 | Ding et al. | 405/200 |
| 2007/0166109 | A1 * | 7/2007 | Ding et al. | 405/224 |
| 2007/0224000 | A1 * | 9/2007 | Mills et al. | 405/203 |
| 2009/0158988 | A1 * | 6/2009 | Ding et al. | 114/266 |

FOREIGN PATENT DOCUMENTS

| | | |
|---|---|---|
| GB | 1225372 | 3/1971 |
| GB | 2168293 | 6/1986 |

(Continued)

OTHER PUBLICATIONS

International Search Report for International Patent Application No. PCT/US2010/046617; European Patent Office, dated Jan. 21, 2011.

(Continued)

*Primary Examiner* — Daniel V Venne
(74) *Attorney, Agent, or Firm* — Locke Lord LLP

(57) ABSTRACT

The present invention increases the heave resistance rate of a barge system from wave motion, as the system is used to install a topsides to offshore structures. One or more heave plates can be coupled at a location below the water surface to one or more barges to change the period of motion of the barge(s) relative to the period of wave motion to better stabilize the barge(s) and resist the heave. A heave plate can be coupled between the barges, or on end(s) or side(s) of the barge(s). In at least another embodiment, each barge can have a heave plate and the heave plates can be releasably coupled to each other. Further, the heave plate can be rotated to an upward orientation during transportation of the topsides to the installation site to reduce drag, and then rotated to a submerged position during the installation of the topsides.

19 Claims, 17 Drawing Sheets

(56) References Cited

FOREIGN PATENT DOCUMENTS

| | | |
|---|---|---|
| GB | 2344574 | 6/2000 |
| RU | 2114025 | 6/1998 |

OTHER PUBLICATIONS

Written Opinion for International Patent Application No. PCT/US2010/046617; European Patent Office, dated Jan. 21, 2011.

* cited by examiner

HEAVE STABILIZED BARGE SYSTEM FOR FLOATOVER TOPSIDES INSTALLATION

CROSS REFERENCE TO RELATED APPLICATIONS

This application is an international application and claims the benefit of U.S. Provisional Application No. 61/236,935, filed Aug. 26, 2009, titled "Heave Stabilized Barge System for Floatover Topsides Installation."

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention disclosed and taught herein relates generally to floating barges used to install a topsides for offshore structures; and more specifically related to systems and methods for stabilizing heave caused by wave action on a barge system during the installation of the topsides.

2. Description of the Related Art

A Spar platform is a type of floating oil platform typically used in very deep waters and is among the largest offshore structures in use. A Spar platform includes a large cylinder or hull supporting a typical rig topsides. The cylinder however does not extend all the way to the seafloor, but instead is moored by a number of mooring lines. Typically, about 90% of the Spar is underwater. The large cylinder serves to stabilize the platform in the water, and allows movement to absorb the force of potential high waves, storms or hurricanes. Low motions and a protected center well also provide an excellent configuration for deepwater operations. In addition to the hull, the Spar's three other major parts include the moorings, topsides, and risers. Spars typically rely on a traditional mooring system to maintain their position.

Installing a deck or topsides to an offshore floating structure has always been a challenge, particularly on deep draft floaters like the Spar, which are installed in relatively deep water. In the past, heavy lifting vessels ("HLV"), including but not limited to, derrick barges have been used for topsides installations. In traditional efforts, the topsides requires multi-lifting, for example five to seven lifts, to install the whole topsides due to the lifting capacity of available HLV and the increasingly larger sizes of topsides. Due to multi-lifting, the steel weight per unity area of the topsides can be higher than that of topsides of fixed platforms installed with a single lifting. If the weight of the topsides is reduced, the weight of the Spar hull to support the topsides may also be reduced. The same principles are applicable to other offshore structures to which a topsides can be mounted.

Recently, catamaran float-over systems have been used to install a topsides onto a Spar platform to resolve the above size challenges. A float-over method is a concept for the installation of the topsides as a single integrated deck onto a Spar hull in which the topsides is loaded and transported with at least two float-over barges to the installation site for the Spar hull. At the installation site, the float-over barges are positioned to straddle the Spar hull with the topsides above the Spar hull, the elevation is adjusted between the topsides and the Spar hull, and the topsides is installed to the Spar hull. Installation of the topsides to the Spar hull by the float-over method can allow a high proportion of the hook-up and pre-commissioning work to be completed onshore prior to installation on the Spar platform, which can significantly reduce both the duration and cost of the offshore commissioning phase. The float-over installation method allows for the installation of the integrated topsides or production deck on a fixed or floating structure without any heavy lift operation.

However, to accomplish the catamaran float-over procedure, the float-over barges are necessarily separated. The separation causes significant load on the barges primarily from the frequency and timing of wave motion on each barge. The vertical movement of the barge from such wave motion is termed "heave." The heave is greatest on the barges when the wave direction impacts the barge perpendicularly to the longitudinal axis of a typical rectangular barge having a length (bow to stern) significantly greater than its width (beam), known as "beam seas". Typically, the least heave occurs when the wave direction impacts the barge parallel along the longitudinal axis known as "head seas", with intermediate heave occurring when the wave direction is at an angle, such as 45 degrees to the longitudinal axis, known as "quartering seas". Depending on the period ("$T_w$") of the wave and therefore distance from crest to crest, one barge can be at a crest of the wave while the other barge is at the trough of the wave, and then the first barge can be at the trough while the other barge is at the crest, as the wave continues to move through the barges.

Similar issues and challenges occur with single barge floatover systems. In single barge systems, the topsides is loaded onto a single barge, the topsides is transported to an installation site on the barge, the barge is typically floated over and between two portions of an offshore structure, and the topsides is installed thereto. The single barge is susceptible to similar heave and differential motion relative to the offshore structure.

With a relative stable offshore structure and a relatively unstable barge affected especially by beam seas, the transfer of the topsides to the offshore structure can be difficult. The heave causes significant differential movement between the topsides and the offshore structure, and complexities in smoothly and efficiently installing the topsides to the offshore structure.

There remains then a need to provide a stabilized barge system for a float-over procedure with a topsides.

BRIEF SUMMARY OF THE INVENTION

The present invention increases the heave resistance rate of a barge system from wave motion, as the system is used to install a topsides to offshore structures. One or more heave plates can be coupled at a location below the water surface to the one or more barges to change the resonance period of motion of the barge or barges relative to the period of wave motion to better stabilize the barge and resist the heave. In at least one embodiment, a heave plate can be coupled between the barges, or on an end or side of a barge. In at least another embodiment, each barge can have a heave plate and the heave plates can be releasably coupled to each other. Further, the heave plate can be rotated to an upward orientation during transportation of the topsides to the installation site to reduce drag during transportation, and then rotated to a submerged position during the installation of the topsides to the offshore structure.

The disclosure provides a catamaran system for installing a topsides onto an offshore structure, comprising: at least two floating vessels, each having a top, bottom, and sides; and a heave plate coupled to at least one floating vessel at least partially below a water level adjacent the vessel, the heave plate adapted to change a heave response of the catamaran system to a sea wave having a pre-defined period, the changed heave response being compared to the heave response of a catamaran system without the heave plate.

The disclosure also provides a method of stabilizing a catamaran system having at least two floating vessels, the catamaran system adapted to position a topsides on an offshore structure, comprising: obtaining at least two floating vessels with a heave plate installed on at least one of the floating vessels; installing the topsides on the floating vessels; transporting the topsides to an installation site; ensuring the heave plate is positioned below a water surface adjacent to at least one floating vessel and extends from at least one floating vessel; positioning the topsides on the offshore structure; releasing the topsides from the floating vessels; and removing the floating vessels from under the topsides.

The disclosure also provides a system for installing a topsides onto an offshore structure, comprising: at least one floating vessel having a top, bottom, and sides; and a heave plate coupled to the floating vessel at a location at least partially below a water level adjacent the vessel, the heave plate adapted to change a heave response of the floating vessel to a sea wave having a pre-defined period, the changed heave response being compared to the heave response of a floating vessel without the heave plate.

The disclosure further provides a method of stabilizing a system having at least one floating vessel, the system adapted to position a topsides on an offshore structure, comprising: obtaining at least one floating vessel with a heave plate installed on the floating vessel; installing the topsides on the floating vessel; transporting the topsides to an installation site; ensuring the heave plate is positioned at least partially below a water surface adjacent the floating vessel and extends from the floating vessel; positioning the topsides on the offshore structure; releasing the topsides from the floating vessels; and removing the floating vessel from the offshore structure.

DETAILED DESCRIPTION

Figure 1:
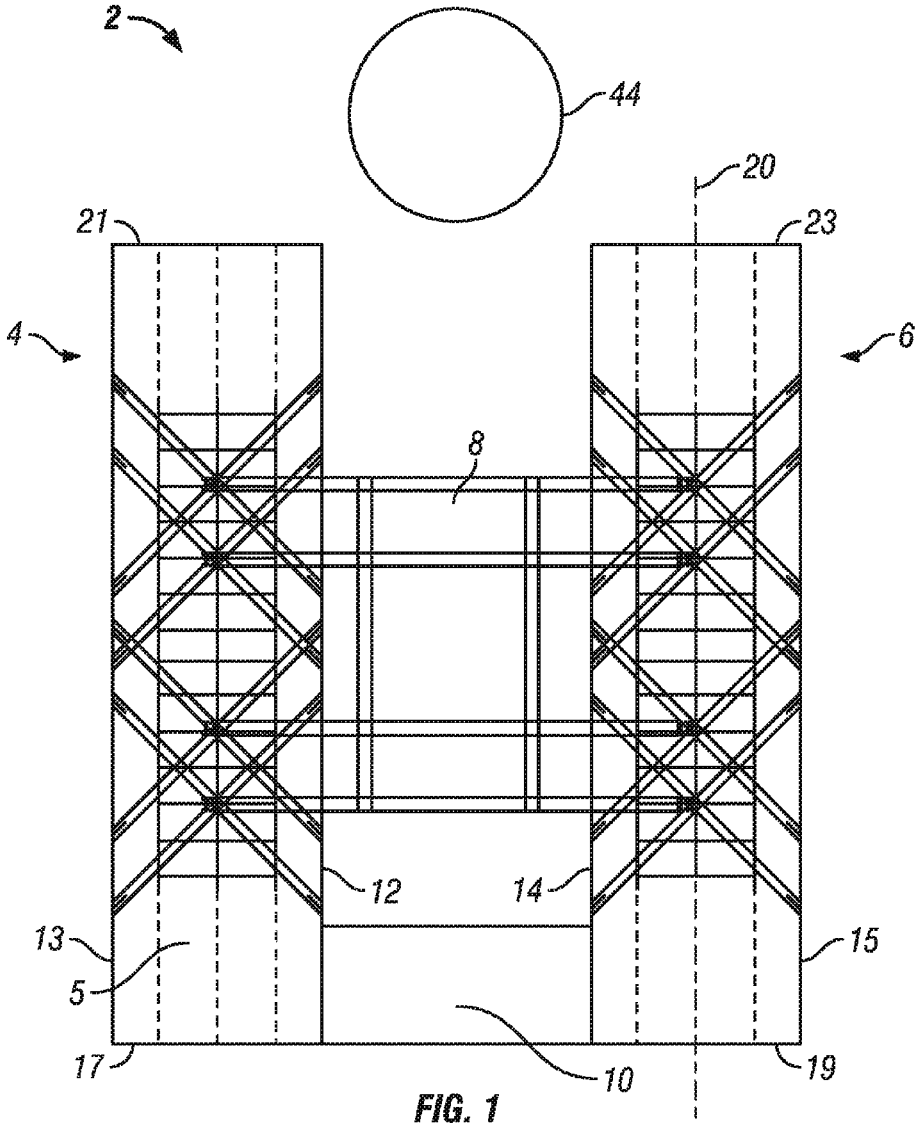
FIG. 1 is a schematic top view of an embodiment of the stabilized catamaran system loaded with a topsides for approaching an offshore floating structure.

The Figures described above and the written description of specific structures and functions below are not presented to limit the scope of what Applicants have invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, elements have been labeled with alphabetical suffixes ("A", "B", and so forth) to designate various similar aspects of the system or device. When referring generally to such elements, the number without the letter may be used. Further, such designations do not limit the number of elements that can be used for that function.

The present invention increases the heave resistance rate of a barge system from wave motion, as the system is used to install a topsides to offshore structures. One or more heave plates can be coupled at a location below the water surface to the one or more barges to change the resonance period of motion of the barge or barges relative to the period of wave motion to better stabilize the barge and resist the heave. In at least one embodiment, a heave plate can be coupled between the barges, or on an end or side of a barge. In at least another embodiment, each barge can have a heave plate and the heave plates can be releasably coupled to each other. Further, the heave plate can be rotated to an upward orientation during transportation of the topsides to the installation site to reduce drag during transportation, and then rotated to a submerged position during the installation of the topsides to the offshore structure. Further, one or more heave plates can be installed on another side or an end of one or more of the barges.

Figure 2:
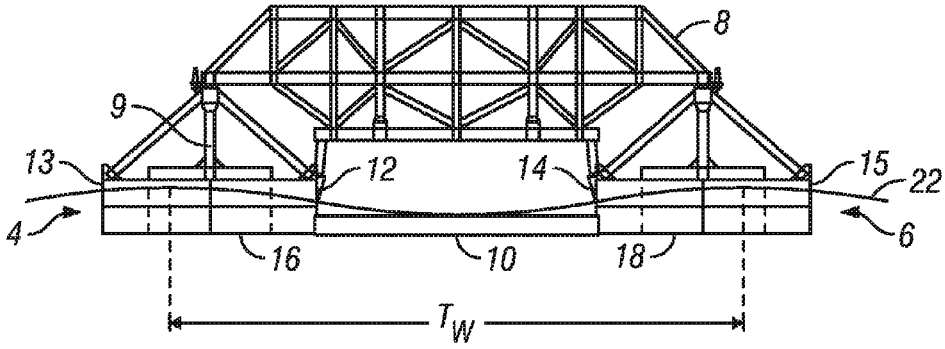
FIG. 2 is a schematic rear view of the stern of the stabilized catamaran system shown in FIG. 1.
Figure 21:
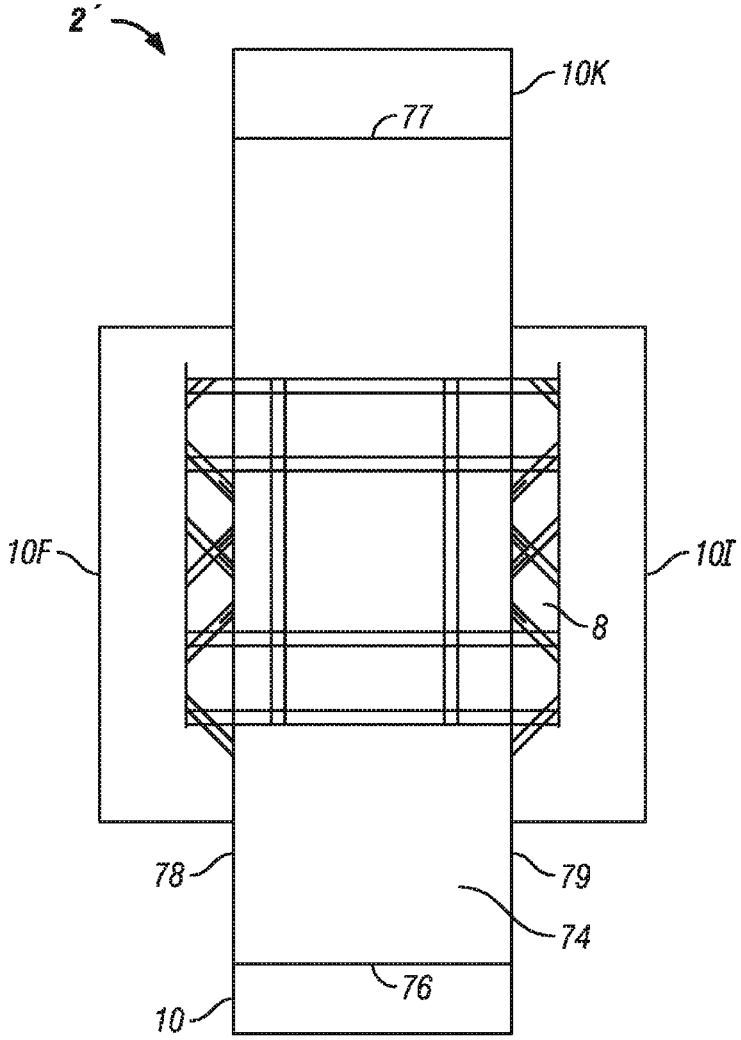
FIG. 21 is a schematic top view of a stabilized system with one barge having one or more heave plates.

FIG. 1 is a schematic top view of an embodiment of the stabilized catamaran system loaded with a topsides for approaching an offshore floating structure. FIG. 2 is a schematic rear view of the stern of the stabilized catamaran system shown in FIG. 1. The figures will be described in conjunction with each other. The stabilized catamaran system 2 generally includes a one or more vessels (generally, two or more), such as barges 4, 6, that are used to install a topsides 8 on an offshore structure 44, such as a Spar hull. In general, the topsides 8 is supported above the top of the barges 4, 6 by one or more supports 9. The term "barge" will be used broadly herein to include any suitable vessel for such purposes of transporting and supporting the topsides during installation. The barge 4 includes a top 5, a bottom 16, an inward side 12, an outward side 13, an end 17 on the stern, and an end 21 on the bow. Similarly, the barge 6 includes a bottom 18, an inward side 14 facing another barge, an outward side 15 distal from the inward side, a stern end 19, and a bow end 23. Generally, the barges are longer from bow to stern than the width across the beam and for purposes herein include a longitudinal axis 20 about which the barge is generally symmetrically shaped, although other shapes are available and can be used. The barges 4, 6 can each be coupled to a heave plate 10. In at least one embodiment, the heave plate 10 is coupled to the sides 12, 14 of the barges 4, 6 respectively. In other embodiments, the heave plate 10 can be coupled to the bottom 16, 18 of each barge. It is envisioned that the coupling will occur prior to towing the topsides 8 to the installation location due to the complexities of installing the heave plate 10 between the barges. However, some installations can include coupling the heave plate 10 at the installation site. The heave plate 10 can be a solid plate or a constructed assembly of a plurality of plates that form a box. Thus, the term "plate" is used broadly herein to include a fabricated structure that functions as a plate or a single plate. The size of the plate can depend upon the distance between the barges and the desired heave resistance created by the heave plate 10 based on model tests, analysis, and perhaps field tests. In general, the heave plate 10 will be located at or near the bottom of the barge or at some distance or distances below the water surface. For illustrative purposes only, a level of the water 22, shown in FIG. 2, can include a wave having a period "$T_w$" between crests. For example, in some design criteria, a typical pre-defined wave period $T_w$ is eight seconds. By altering the resonance of the catamaran system 2 using the heave plate 10, the relative movement of the catamaran system can be significantly stabilized in spite of the changes in level of the water 22 as shown in FIG. 21 as a wave passes by the catamaran system.

If the heave plate 10 is coupled to the barges 4, 6 prior to installation, then generally the catamaran system 2 will approach the offshore structure 44 in the direction of the bow with the bow ends 21, 23 facing the offshore structure. This direction of approach allows the catamaran system 2 to position the topsides 8 directly overhead of the offshore structure 44 without interfering with the heave plate 10 coupled between the barges 4, 6.

Figure 3:
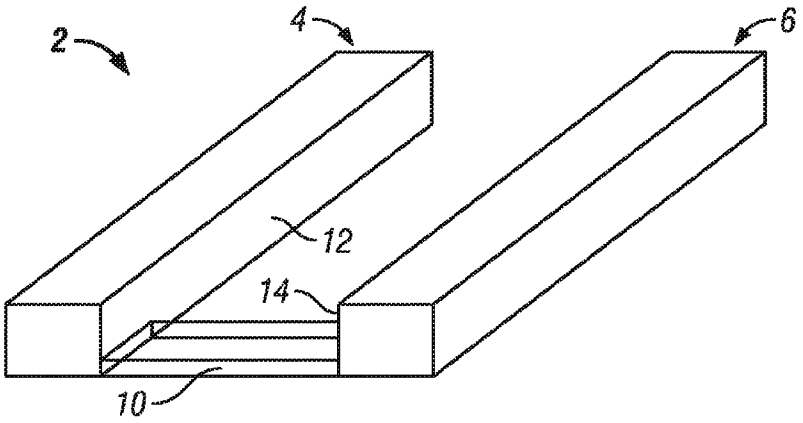
FIG. 3 is a schematic perspective view of the stabilized catamaran system shown in FIG. 1 without the topsides.
Figure 4:
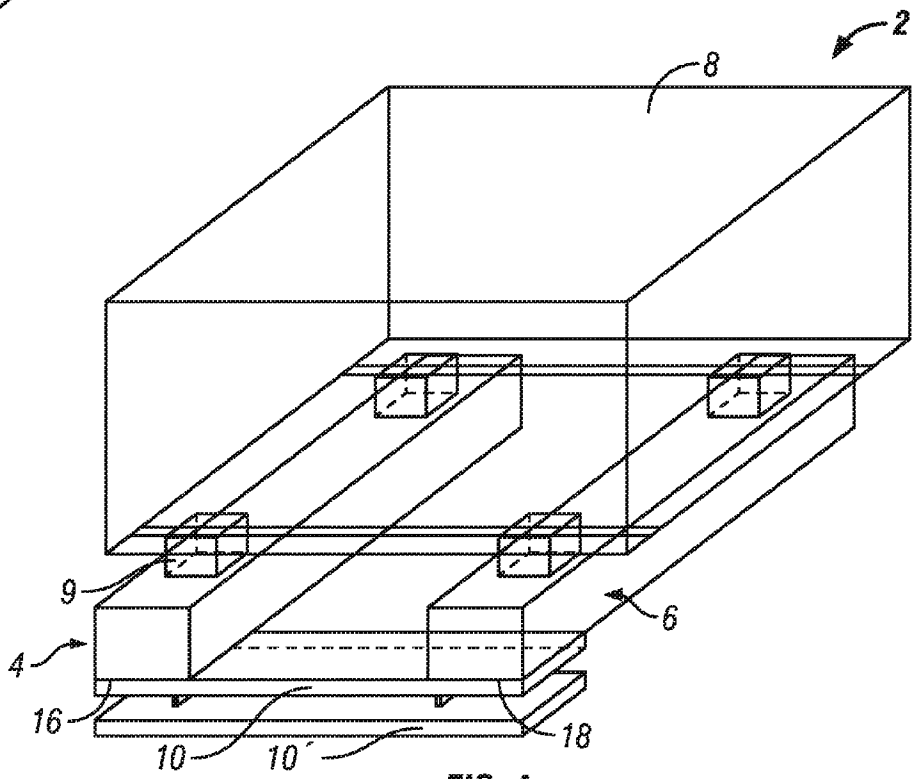
FIG. 4 is a schematic perspective view of the stabilized catamaran system shown in FIG. 1 with the topsides loaded on the catamaran system.

FIG. 3 is a schematic perspective view of the stabilized catamaran system shown in FIG. 1 without the topsides. FIG. 4 is a schematic perspective view of the stabilized catamaran system shown in FIG. 1 with the topsides loaded on the catamaran system. The figures will be described in conjunction with each other. The catamaran system 2 can include the heave plate 10 mounted between the side 12 of the barge 4 and the side 14 of the barge 6. Alternatively, the heave plate 10 can be mounted to the bottoms 16, 18 of the barges 4, 6, as shown in FIG. 4. In some embodiments, the heave plate 10 can be mounted below the barges 4, 6, such as in the position of a heave plate 10'. Still further, in some embodiments, the heave plate 10 can include a plurality of heave plates, such as a combination of the heave plate 10 attached to the bottom of the barges 4, 6 coupled with an additional heave plate 10' coupled below the heave plate 10 and separated by a distance therefrom. Other styles and assemblies of the heave plate 10 can include multiple heave plates, multiple levels of heave plates, different sizes of heave plates within the assembly itself, and other variations, with the goal that the heave plate 10 functions to change the resonance period of the catamaran system 2, that is, the catamaran system's response to a wave. Such change in the resonance period can generally be seen as caused by an increased resistance due to the surface area of the heave plate 10 contacting a quantity of water above the heave plate that resists movement of the heave plate, and by the increased mass of the heave plate added to the barges.

Figure 5:
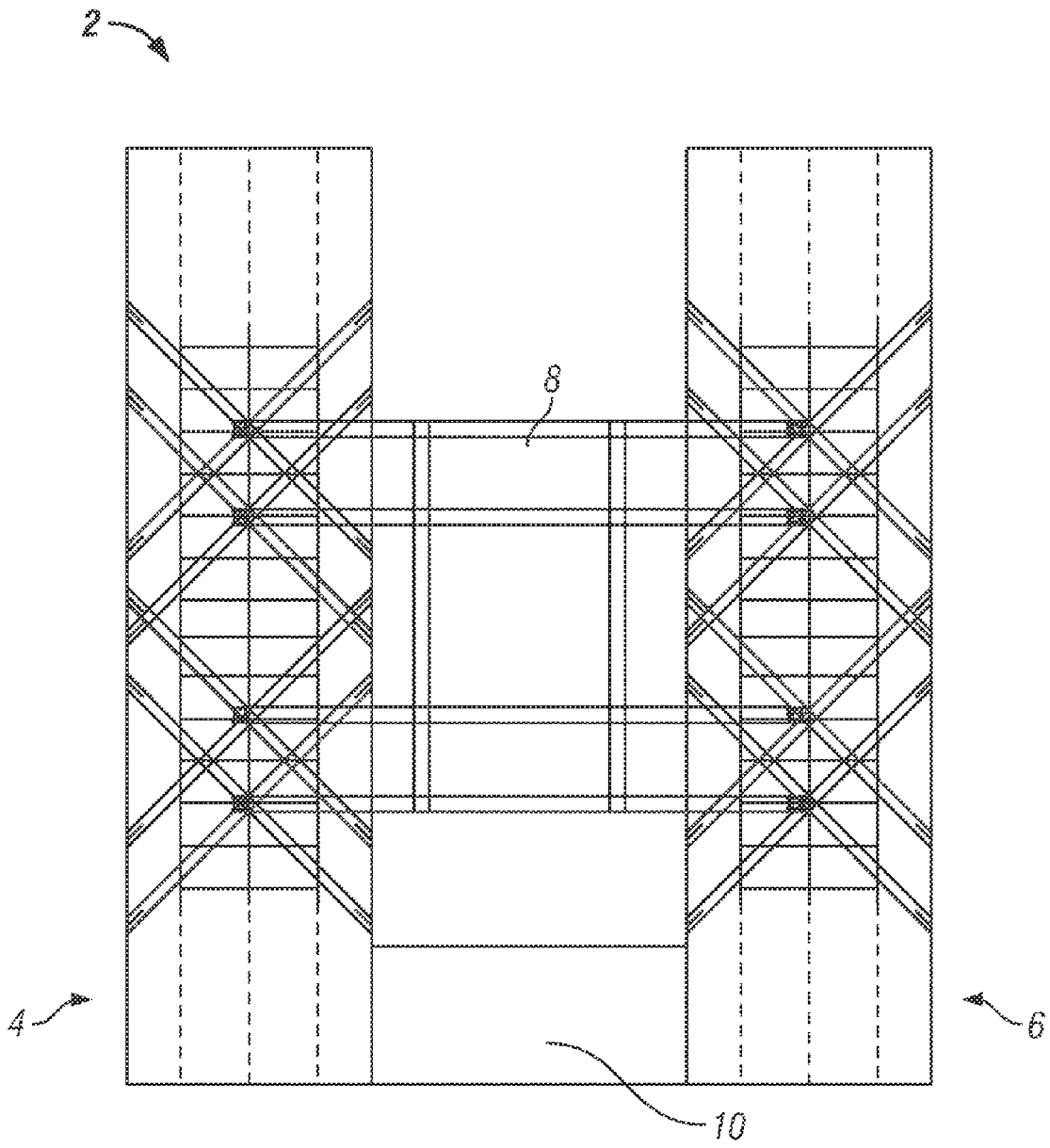
FIG. 5 is a schematic top view of the stabilized catamaran system shown in FIG. 1 with the topsides positioned directly over the offshore floating structure.

FIG. 5 is a schematic top view of the stabilized catamaran system shown in FIG. 1 with the topsides positioned directly over the offshore floating structure. After the catamaran system 2 positions the topsides over the offshore structure 44 shown in FIG. 1, the offshore structure can be raised to engage the underside of the topsides. The barge supports 9 can be released, so that the topsides 8 can be decoupled from the barges 4, 6. The installation at that critical time can advantageously use the increased heave resistance from the heave plate 10, so that the barges 4, 6 do not heave as greatly as they would otherwise without the heave plate.

Figure 6:
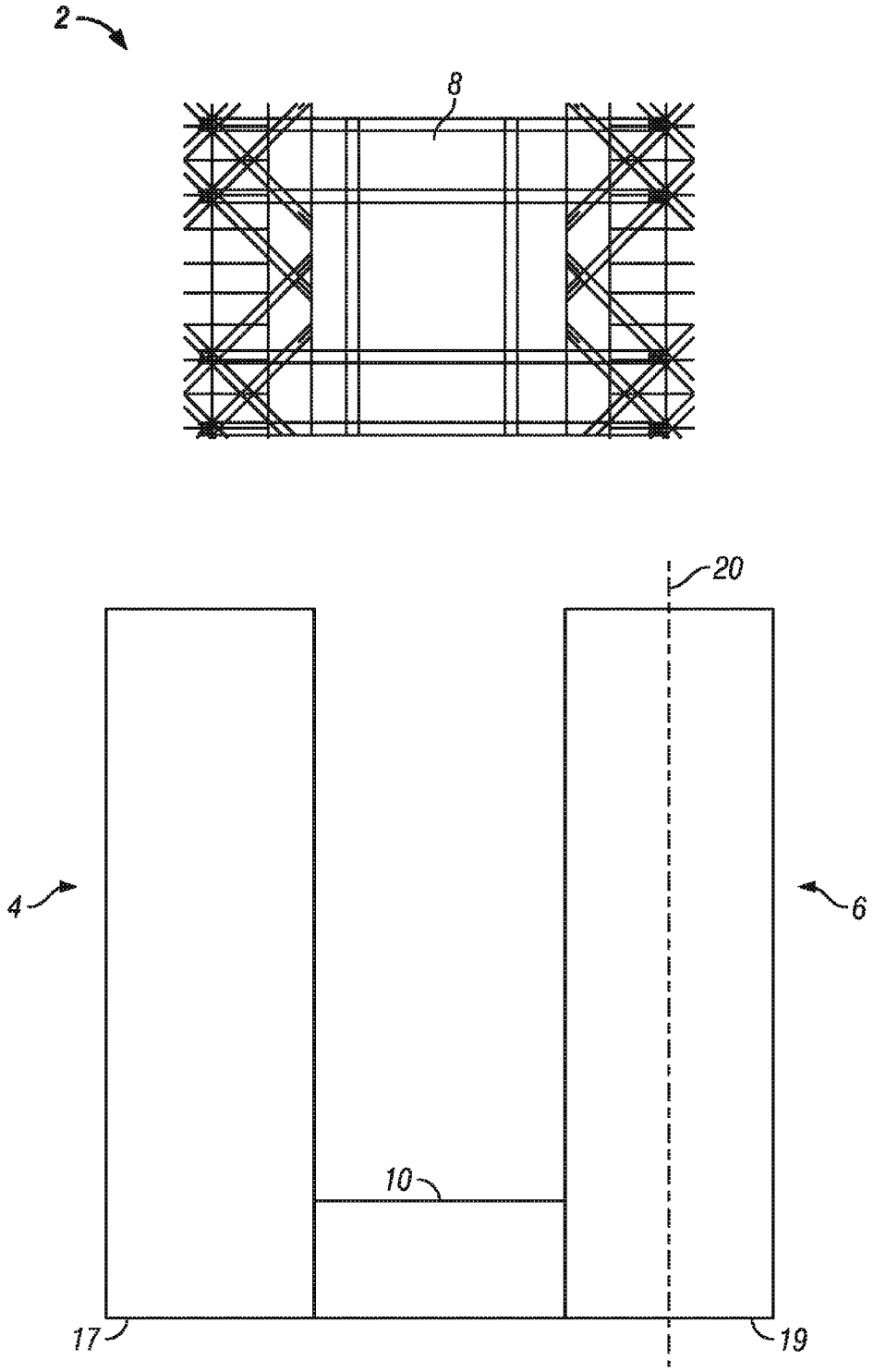
FIG. 6 is a schematic top view of the stabilized catamaran system shown in FIG. 1 with the topsides installed on the offshore floating structure and the catamaran system pulled away from the offshore floating structure.

FIG. 6 is a schematic top view of the stabilized catamaran system shown in FIG. 1 with the topsides installed on the offshore floating structure and the catamaran system pulled away from the offshore floating structure. After the topsides 8 is secured to the underlying offshore structure, the catamaran system 2 is moved from the installation location. Because the heave plate 10 is coupled to the barges 4, 6, the direction is the reverse of FIG. 1 approaching the offshore structure, that is, the stern ends 17, 19 of the barges 4, 6 are pulled backwards. It is envisioned that the heave plate 10 will remain attached to the barges 4, 6 in most installations. Generally, it is desirable to quickly move the barges from under the topsides 8, after the topsides is installed to the offshore structure to lessen the risk of heave damage to the various structures. With the heave plate 10 still attached to the barges 4, 6, the lengthwise movement of the barges from the installation site is longer along the longitudinal axis 20 compared to a lateral movement that would be perpendicular to the longitudinal axis 20.

Figure 7:
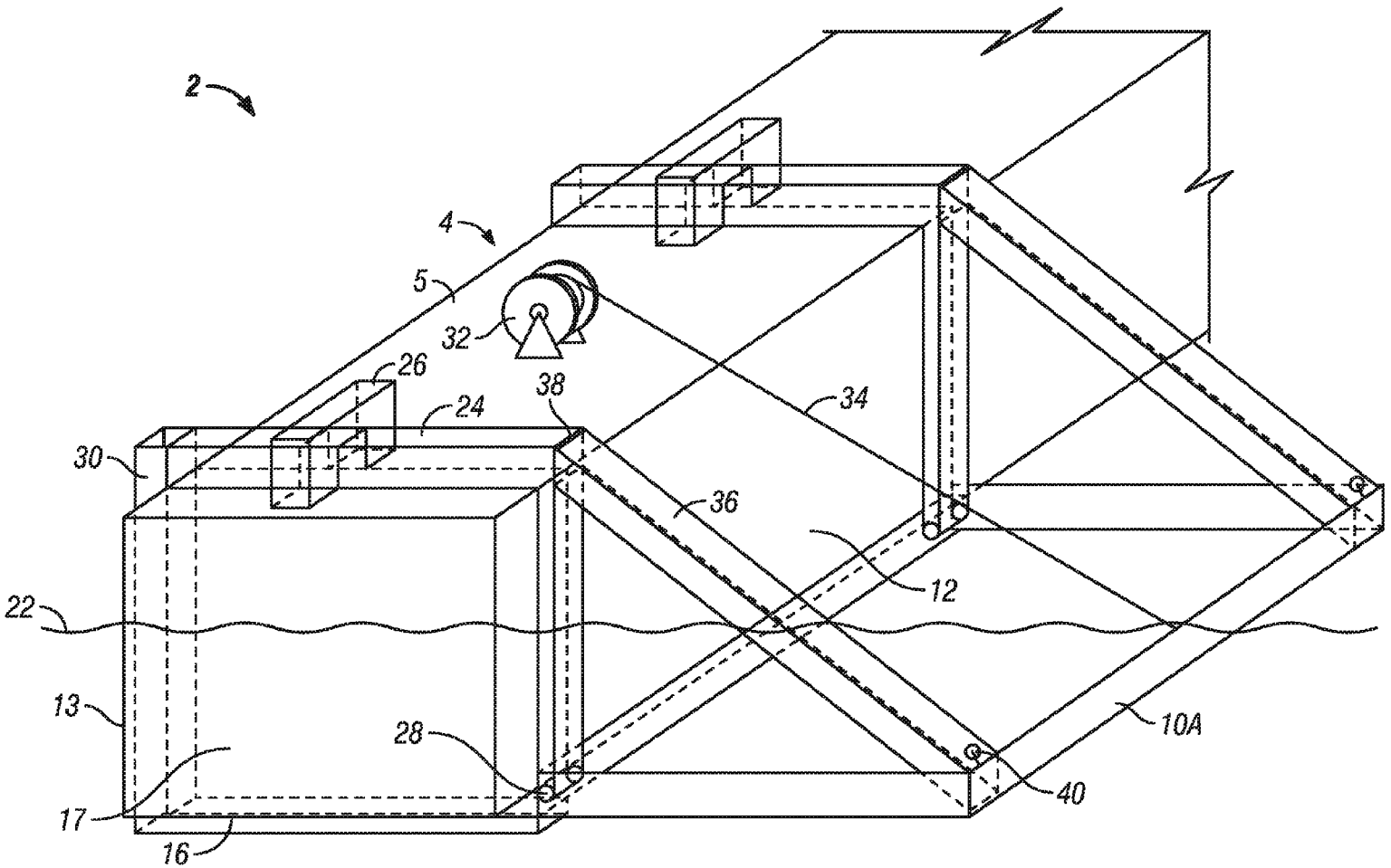
FIG. 7 is a schematic perspective partial view of another embodiment of the stabilized catamaran system with a heave plate deployed.

FIG. 7 is a schematic perspective partial view of another embodiment of the stabilized catamaran system with a heave plate deployed. This embodiment provides a heave plate that is attached to each barge and can be coupled to each other during the installation and yet allows a lateral movement of the barges away from the installation site. A lateral movement is generally considered a more rapid movement away from the offshore structure compared to the longitudinal movement described in FIG. 6.

Various heave plates and various assemblies supporting the heave plates can be used. The examples below are merely illustrative and are not limiting to the particular structures, framework, mechanisms, and positioning. It is known that modifications of the hulls of barges are generally discouraged, especially along the bottom of a barge and at least to some degree along the sides of a barge. Thus, the embodiment shown at least in FIG. 7 and related figures includes a support structure for the heave plate that can be removed as needed without damaging at least the bottom of the barges, and yet still allows the heave plate 10 to be mounted to the barge below the water level. A main support structure 24 can be coupled to the barge 4 generally along the top 5 and down the side 12. The main support structure 24 can be coupled to the barge 4 with a locking system 26. The locking system 26 can engage one or more existing attachment points on the barge that are routinely used for various purposes.

In the embodiment shown in FIG. 7, the heave plate 10A can be hingeably coupled about a hinge 28 to the main support structure 24. The hinge 28 can be located on the main support structure 24 at some appropriate elevation relative to the level of the water 22. A secondary support structure 30 can also be coupled to the main support structure 24 and extend along the side 13 distal from the side 12 and along the bottom 16 distal from the top 5, so that the ends of the secondary support structure 30 can be coupled to the ends of the main support structure 24 or some other appropriate location between the support structures to create a "belt" around the barge 4. Because the heave plate 10A can be rotated about the hinge 28, one or more devices can be used to raise and lower the heave plate 10A. For example, and without limitation, a winch 32 having a cable 34 can be coupled to the heave plate 10A with suitable electrical/mechanical controls to activate the winch 32.

The heave plate 10 can be secured in a deployed position by one or more braces 36. The brace 36 will generally be a stiff brace, such as tubing or other structural member, which can withstand the forces as the barge 4 heaves in the catamaran system 2. The brace 36 can be coupled to the main support structure 24 with a locking system 38, and can be coupled with the heave plate 10A with a locking system 40. The locking system can include pins, cables, fasteners, and other securing devices, and counterparts of the securing devices, such as openings, on the support structures. As shown in FIG. 7, the system will generally include at least two such assemblies of main support structures, secondary support structures, and other corresponding structures, depending on the length of the heave plate 10A.

Figure 8:
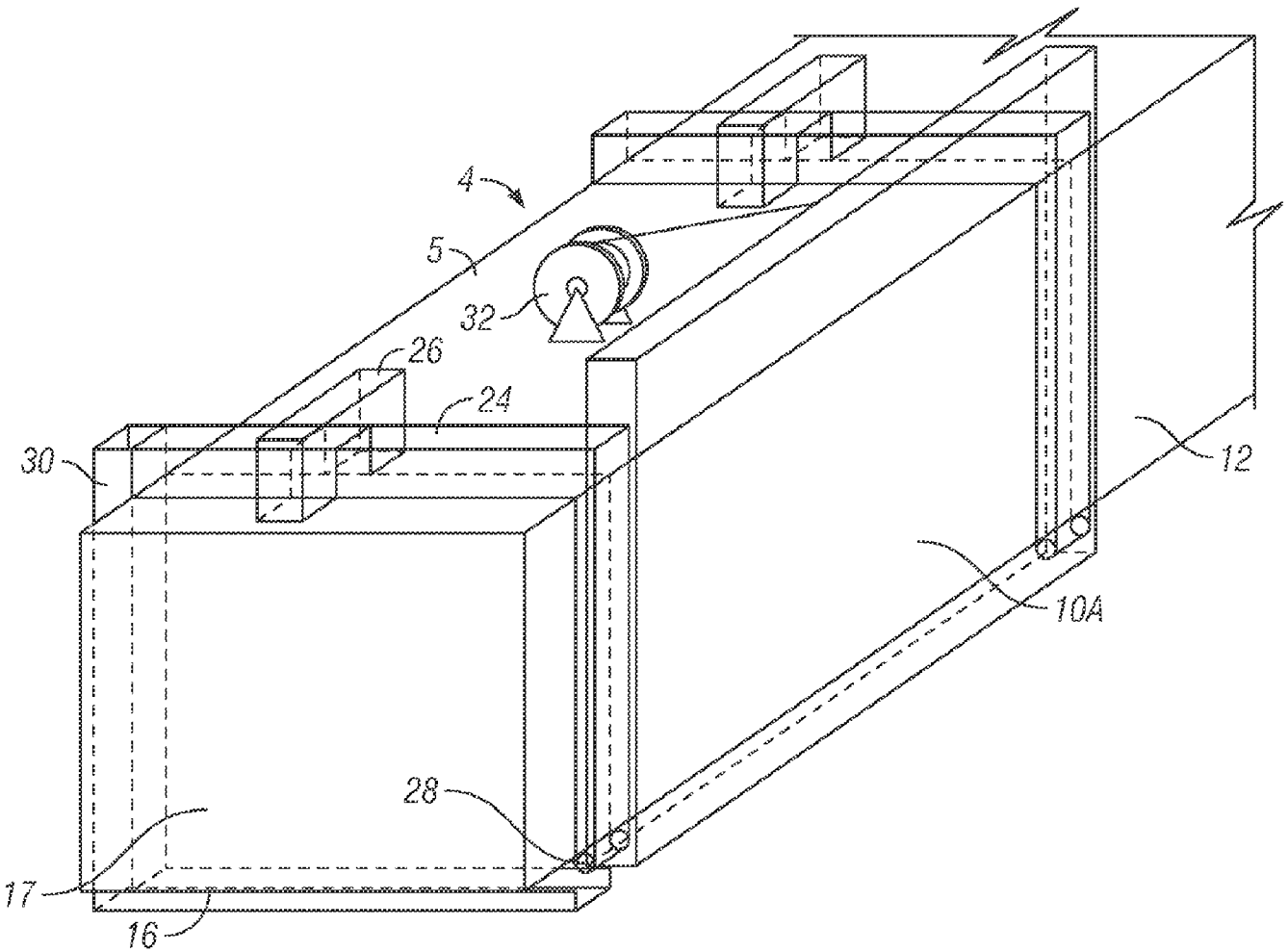
FIG. 8 is a schematic perspective partial view of the stabilized catamaran system of FIG. 7 with the heave plate stowed in an upright position.

FIG. 8 is a schematic perspective partial view of the stabilized catamaran system of FIG. 7 with the heave plate stowed in an upright position. During transportation, the heave plate can be stowed in an upright, raised position and secured to the main support structure 24 or intermediate structure between the heave plate and the support structure. The heave plate can be pulled to such an upright position by the winch 32, as the heave plate rotates about the hinge 28. In the upright position, the heave plate 10 generates less water resistance during the barge transportation to the installation site.

Figure 9:
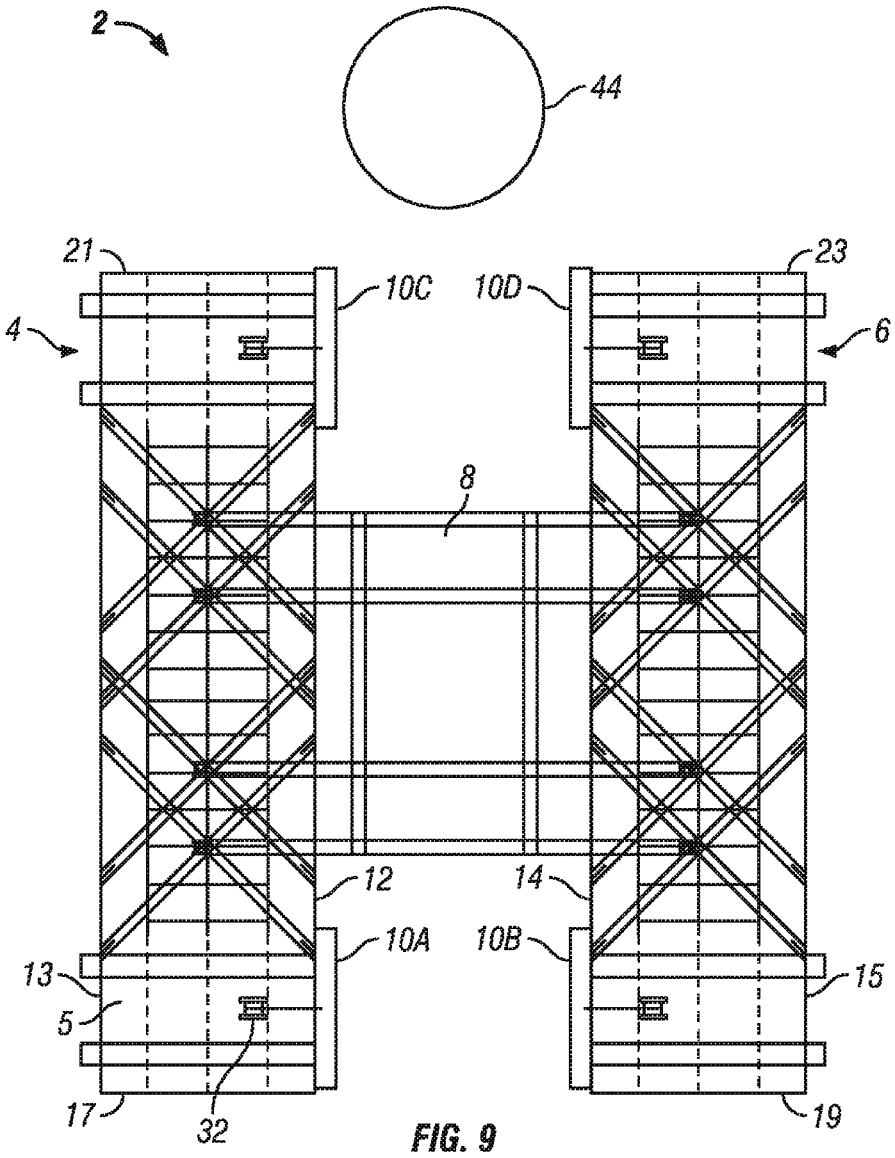
FIG. 9 is a schematic top view of the stabilized catamaran system shown in FIG. 7 loaded with a topsides for approaching an offshore floating structure.
Figure 10:
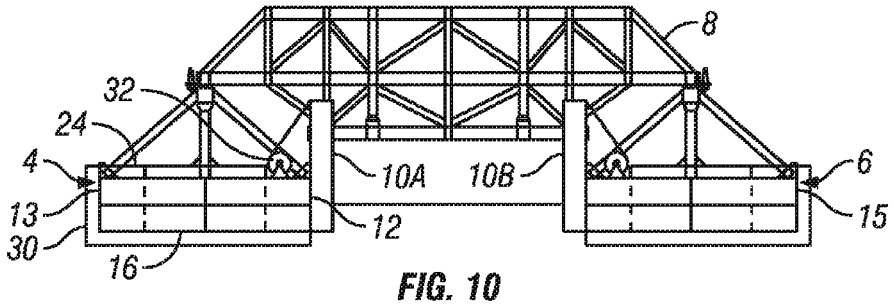
FIG. 10 is a schematic rear view of the stern of the stabilized catamaran system shown in FIG. 9.

FIG. 9 is a schematic top view of the stabilized catamaran system shown in FIG. 7 loaded with a topsides for approaching an offshore floating structure. FIG. 10 is a schematic rear view of the stern of the stabilized catamaran system shown in FIG. 9. The figures will be described in conjunction with each other. In operation, the catamaran system 2 can be brought close to the offshore structure 44 in a similar manner as described in reference to FIG. 1 with a difference being that the heave plate on the barge 4 and the heave plate on the barge 6 can remain in a stowed position. Further, because the heave plate can be raised to allow passage of the offshore structure therethrough, one or more heave plates can be located toward the bow ends 21, 23 of the barges 4, 6 that are used to approach the offshore structure 44. While four heave plates 10A-10D are shown in FIG. 9, it is to be understood that more or less heave plates can be coupled to the catamaran system 2. The heave plates 10A, 10B are shown in a stowed position toward the rear or stern of the catamaran system 2, mainly near the ends 17, 19. However, the heave plates 10A, 10B can be lowered to a deployed position prior to the installation, because the barge-to-barge clearance for the catamaran system 2 beside the offshore structure 44 does not benefit from the heave plates 10A, 10B being in a stowed, raised position. The braces 36 can be coupled between the support frame 24 and the heave plate 10A, with corresponding braces coupled on corresponding structures between the barge 6 and the heave plate 10B. Further, the heave plates 10A, 10B can be coupled together to provide further rigidity to the combined heave plate surface formed from heave plates 10A, 10B.

Figure 11:
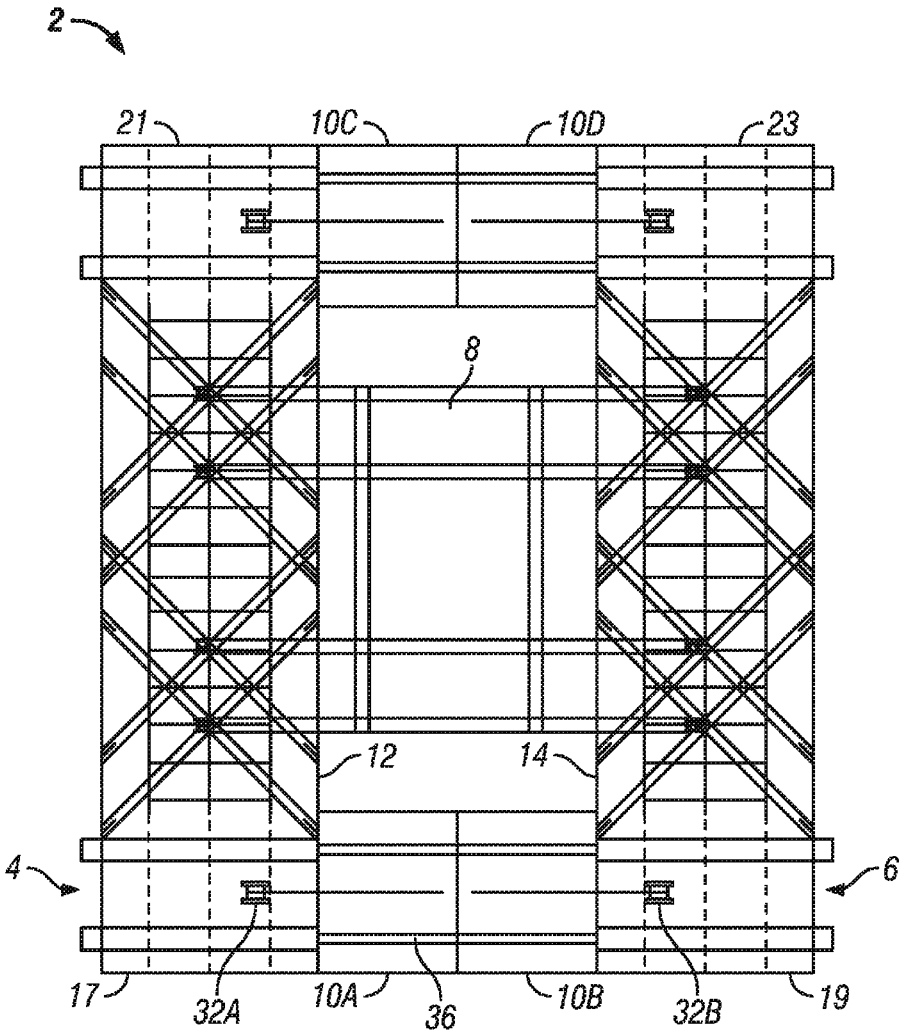
FIG. 11 is a schematic top view of the stabilized catamaran system shown in FIG. 9 with the topsides positioned directly over the offshore floating structure.
Figure 12A:
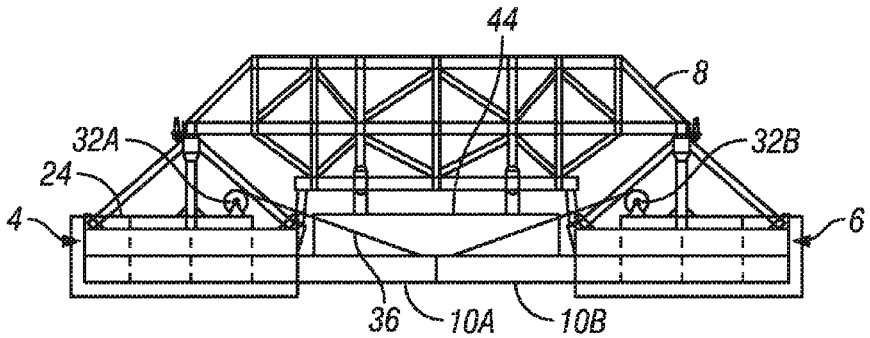
FIG. 12A is a schematic end view of the stabilized catamaran system shown in FIG. 9 with heave plates deployed.

FIG. 11 is a schematic top view of the stabilized catamaran system shown in FIG. 9 with the topsides positioned directly over the offshore floating structure. FIG. 12A is a schematic end view of the stabilized catamaran system shown in FIG. 9 with heave plates deployed. The figures will be described in conjunction with each other. Generally, after the catamaran system 2 has sufficiently passed the topsides 8, the heave plates 10C, 10D disposed toward the bow ends 21, 23 of the barges 4, 6, respectively, can be lowered and put into a deployed position with appropriate bracing. Further, the heave plates 10C, 10D can be coupled together to provide further rigidity to the combined heave plate surface formed from heave plates 10C, 10D.

Figure 12B:
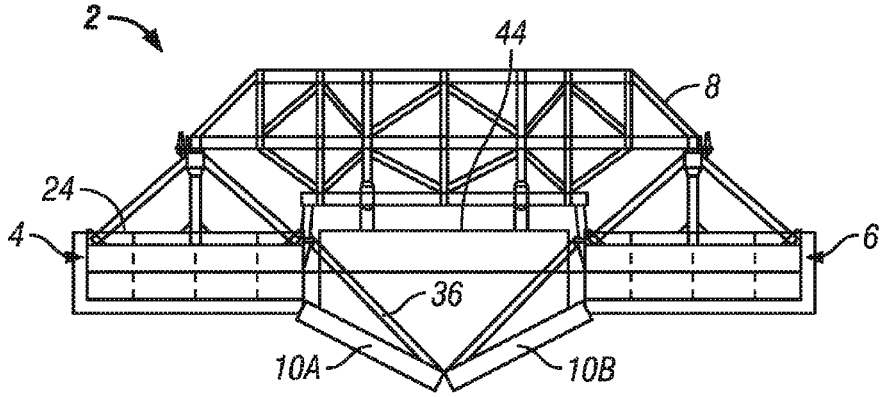
FIG. 12B is a schematic end view of the stabilized catamaran system shown in FIG. 9 with heave plates deployed.

FIG. 12B is a schematic end view of the stabilized catamaran system shown in FIG. 9 with heave plates deployed. The heave plates 10A, 10B for the barges, 4, 6 can be deployed at one or more angles depending on the point of coupling to the frame 24 and the length of the brace 36. Further, longer heave plates 10A, 10B (as illustrated) allow the heave plates to meet at angles other than planar to each other.

Figure 13:
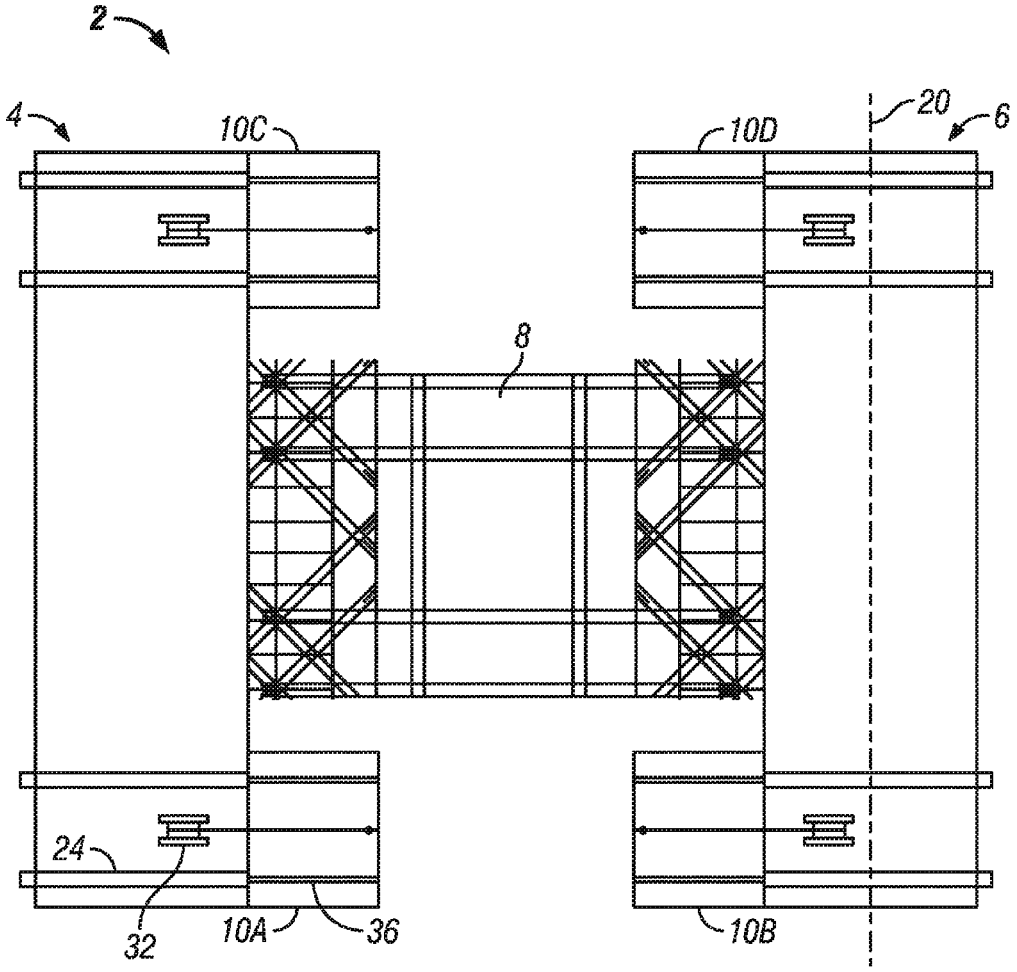
FIG. 13 is a schematic top view of the stabilized catamaran system shown in FIG. 9 with the topsides installed on the offshore floating structure and the catamaran system pulled away from the offshore floating structure.

FIG. 13 is a schematic top view of the stabilized catamaran system shown in FIG. 9 with the topsides installed on the offshore floating structure and the catamaran system pulled away from the offshore floating structure. The topsides 8 can be installed on the offshore structure 44 shown in FIG. 9 and the barge can be released from the topsides 8. If the heave plates 10C, 10D have been coupled together, then the coupling can be removed. Similarly, if the heave plates 10A, 10B have been coupled together, then such coupling can be removed. The barges 4, 6 can be moved laterally away from the topsides 8, such as in a perpendicular direction to the longitudinal axis 20. Such lateral movement may be faster than longitudinal movement due to the relative distances between the length of the barges and the beam of the barges. The heave plates 10A-10D can be left deployed or raised to a stowed position, as is appropriate under the circumstances.

Figure 14:
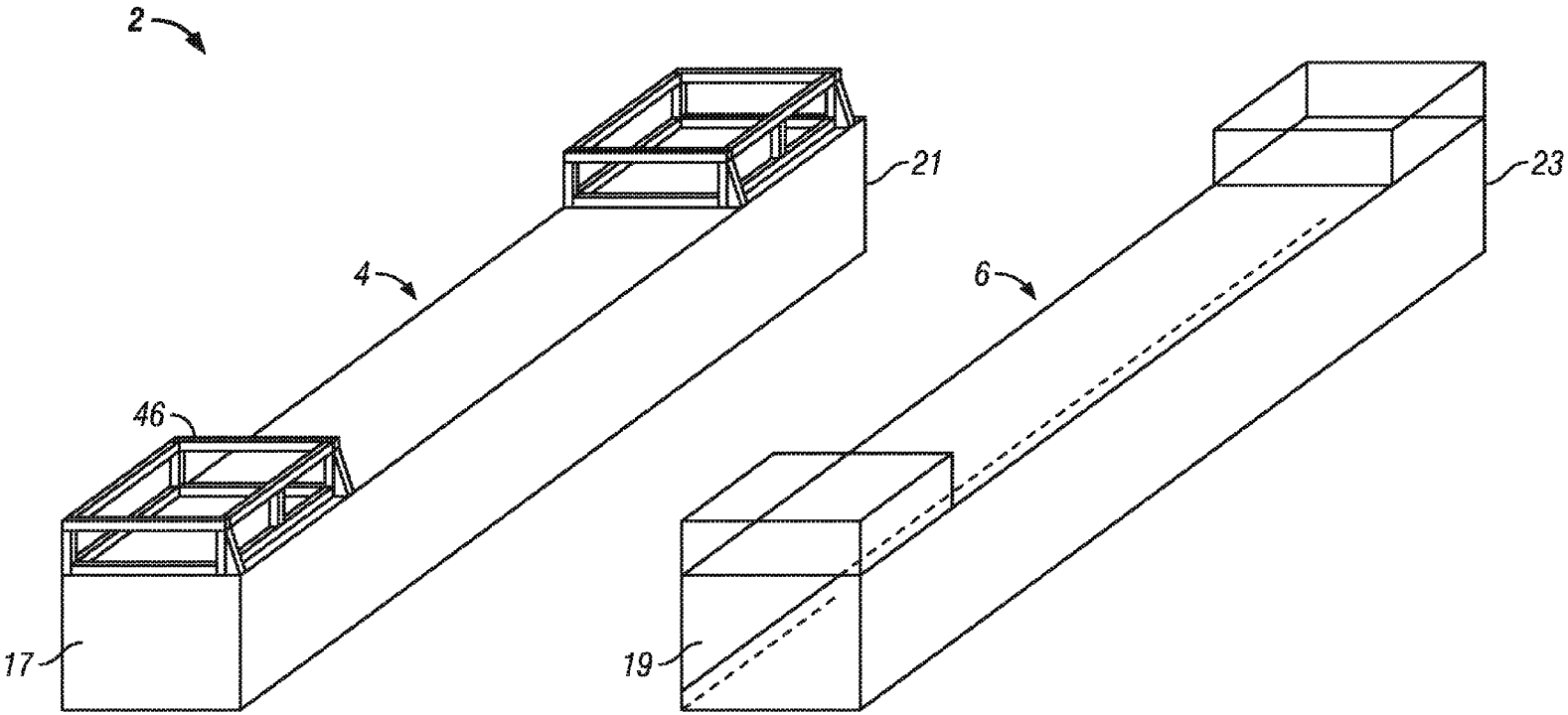
FIG. 14 is a schematic perspective partial view of another embodiment of the stabilized catamaran system with a main support structure.

FIG. 14 is a schematic perspective partial view of another embodiment of the stabilized catamaran system 2 with a main support structure. As another example, the stabilized catamaran system 2 can include a variety of main support structures, such as an elevated main support structure 46. The support structure 46 can be coupled to the barge 4, with a corresponding structure coupled to the barge 6, in a variety of locations. Generally, the locations will be toward each of the ends 17, 21 of the barge 4 and each of the ends 19, 23 of the barge 6. The elevation of the main structure 46 can vary depending upon the structure of the heave plate 10 with consideration being given to ease of access of components for assembly and disassembly of the heave plate with the main support structure.

Figure 15:
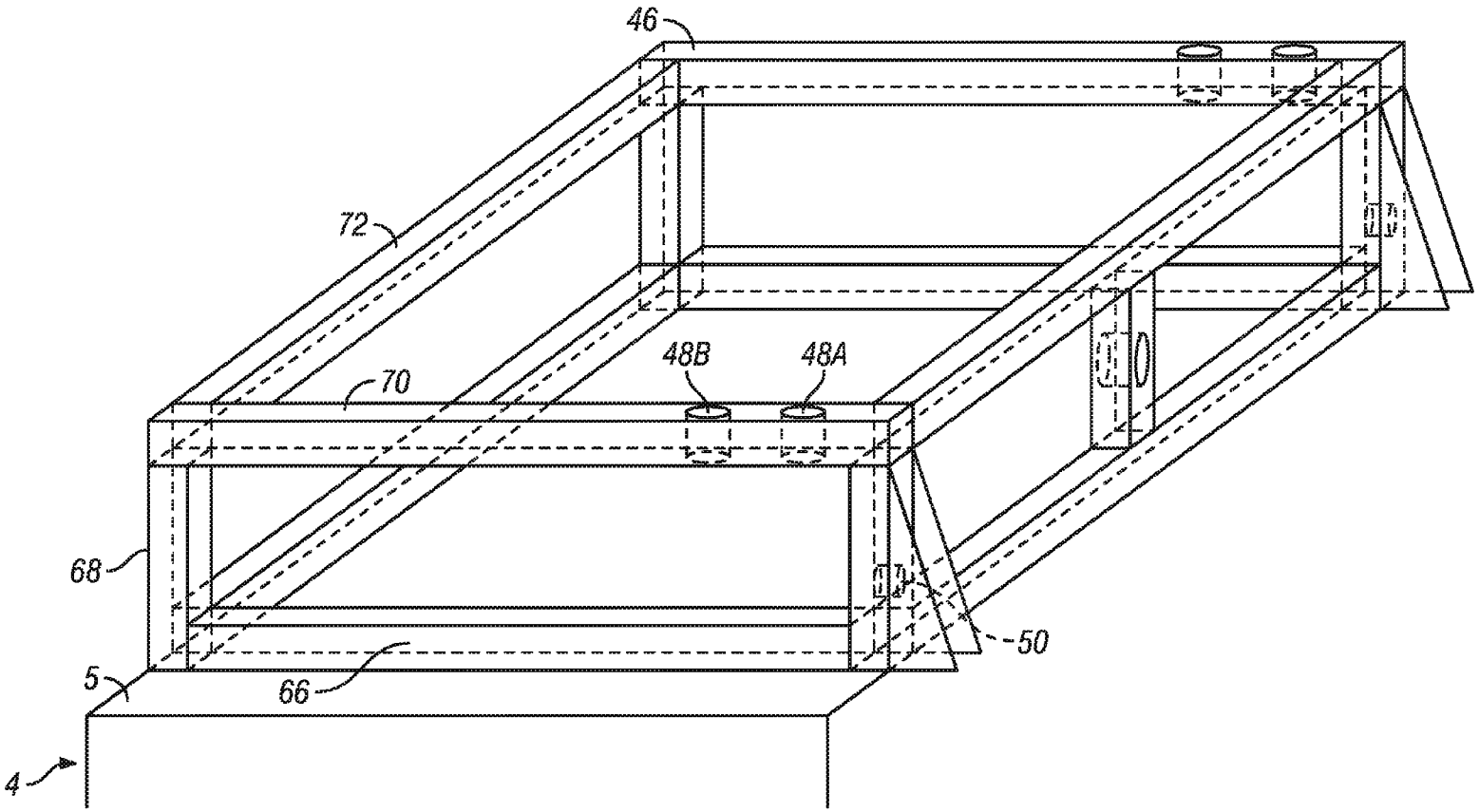
FIG. 15 is a schematic perspective view of details of the main support structure shown in FIG. 14.

FIG. 15 is a schematic perspective view of details of the main support structure shown in FIG. 14. As an exemplary main support structure 46, a lower member 66 can form a grid pattern that can be coupled to the barge 4, such as to the top 5. One or more upright members 68 can extend upward from the lower member 66 to some appropriate elevation. One of more top members 70 can be coupled to the upright members 68 above the lower member 66. A coupling member 72 can be used to couple the frame formed by the members 66, 68, 70 to other such frames spaced at appropriate intervals to support the heave plate 10A. One or more locking stations, such as horizontal locking stations 48A, 48B, can be formed in the top member 70 or other members as appropriate. For example, the locking stations 48 can include an opening through which pins, fasteners, and other devices can be inserted. Similarly, one or more vertical locking stations 50 can be formed on a vertical plane, such as in the upright member 68 to also be used to couple the heave plate 10A to the main support structure 46. Similar main support structures can be made and positioned at other locations on the barges 4, 6 for other heave plates.

Figure 16:
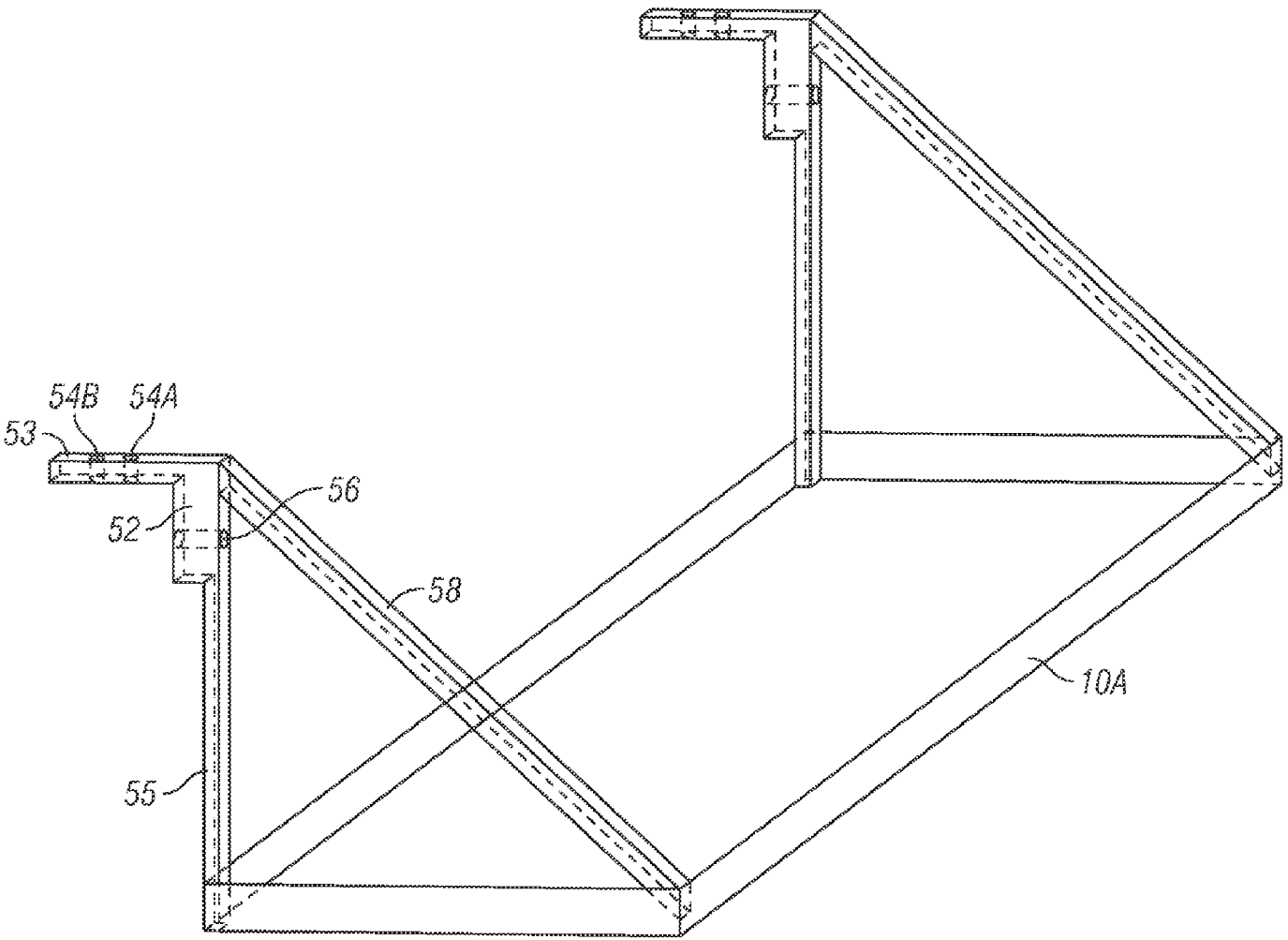
FIG. 16 is a schematic perspective view of a heave plate with a complementary heave plate support structure for coupling with the main support structure shown in FIG. 15.

FIG. 16 is a schematic perspective view of a heave plate with a complementary heave plate support structure for coupling with the main support structure shown in FIG. 15. FIG. 16 shows an assembly of the heave plate 10A with a heave plate port structure 52. The heave plate support structure 52 is generally formed to be coupled with the main support structure 46, described above in FIG. 15. For example, the heave plate support structure 52 can include an appendage 53 extending from the main portion of the heave plate support structure 52 that includes one or more heave plate horizontal locking stations 54A, 54B. The heave plate horizontal locking stations 54A, 54B are sized and spaced to allow coupling with the horizontal locking stations 48A, 48B formed in the main support structure 46. Similarly, the heave plate support structure 52 can include a heave plate vertical locking station 56 also formed and sized to allow coupling with the vertical locking station 50 on the main support structure 46. A brace 58 can be coupled between the heave plate support structure 52 and the heave plate 10A to provide rigidity and stiffness to the combination of elements. For example, the brace 58 can be coupled to an upper portion of the heave plate support structure 52 and to an outermost portion of the heave plate 10A relative to the heave plate support structure 52. Further, the heave plate support structure 52 can include an extension 55 that extends downward and can be used to couple other portions of the heave plate 10A to the heave plate support structure 52.

Figure 17:
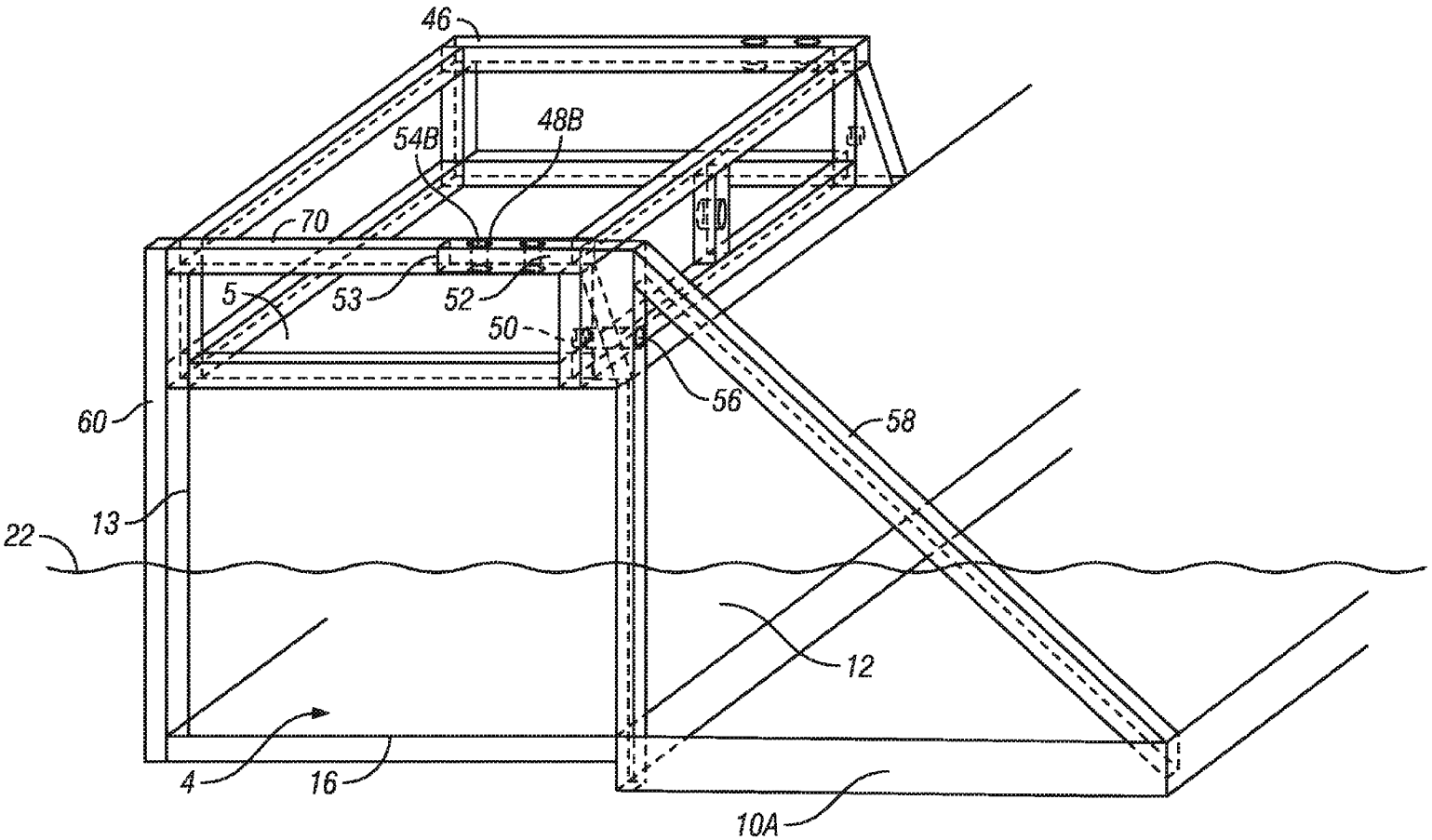
FIG. 17 is a schematic top view of the main support structure coupled with the heave plate support structure of FIGS. 15 and 16.
Figure 18:
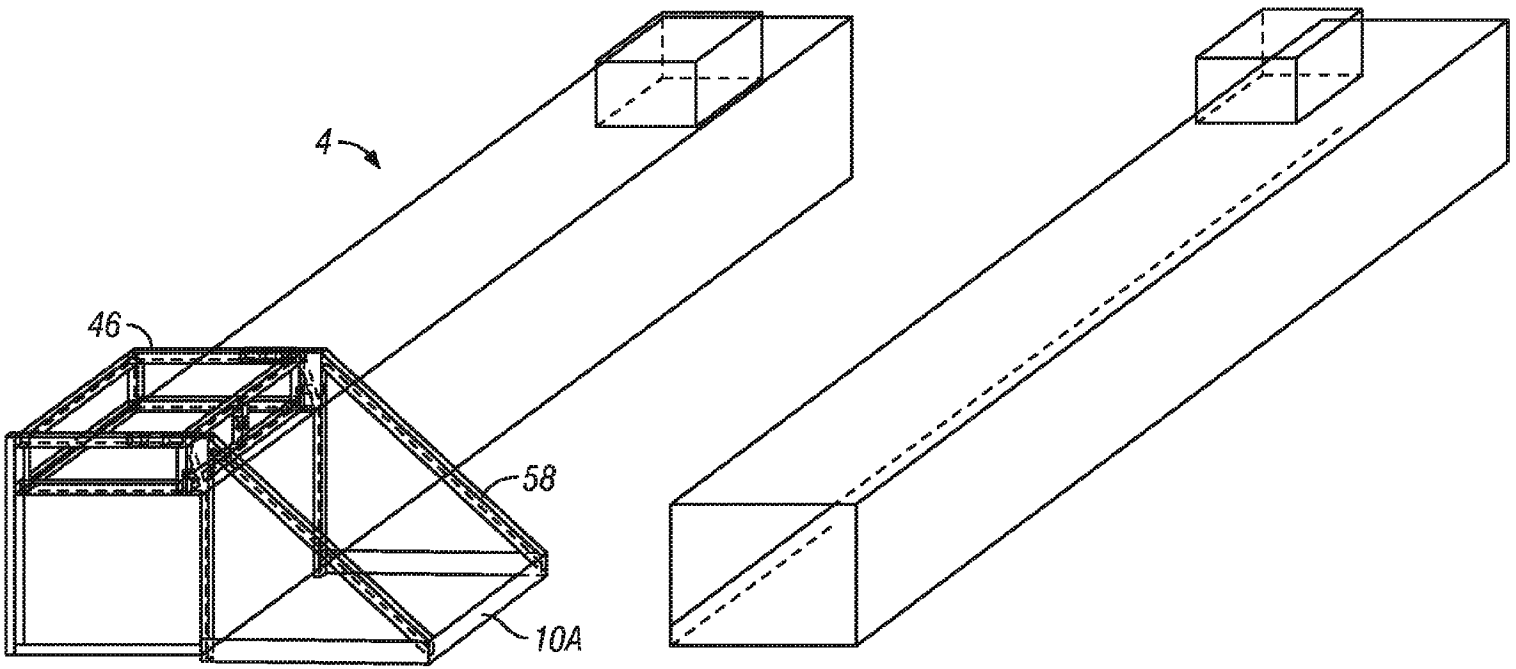
FIG. 18 is a schematic perspective view of the main support structure and the heave plate support structure of FIG. 17 coupled with the barge of the catamaran system.

FIG. 17 is a schematic top view of the main support structure coupled with the heave plate support structure of FIGS. 15 and 16. FIG. 18 is a schematic perspective view of the main support structure and the heave plate support structure of FIG. 17 coupled with the barge of the catamaran system. The figures will be described in conjunction with each other. The heave plate support structure 52 with the heave plate 10A can be coupled to the main support structure 46, which in turn can be coupled to the barge 4. A secondary support structure 60 can also be coupled to the main support structure 46 and extend along the side 13 distal from the side 12 and along the bottom 16 distal from the top 5, so that the ends of the secondary support structure 30 can be coupled to the ends of the main support structure 46 or some other appropriate location between the support structures to create a "belt" around the barge 4. The appendage 53 can be inserted into a cavity of the top member 70, so that the horizontal locking stations of the main support member 46 can be engaged with the horizontal locking stations of the heave plate support structure 52, such as locking station 48B engaged with locking station 54B. Similarly, the vertical locking station 56 can be engaged with the vertical locking station 50. The elevation of the heave plate 10A can be at some distance below the water level 22 that can be adjacent the bottom 16 of the barge 4 or at some other elevation higher or lower than the bottom 16. Further, as shown in FIG. 4, multiple heave subplates can be stacked at various elevations below the water surface that collectively form the heave plate 10.

Figure 19:
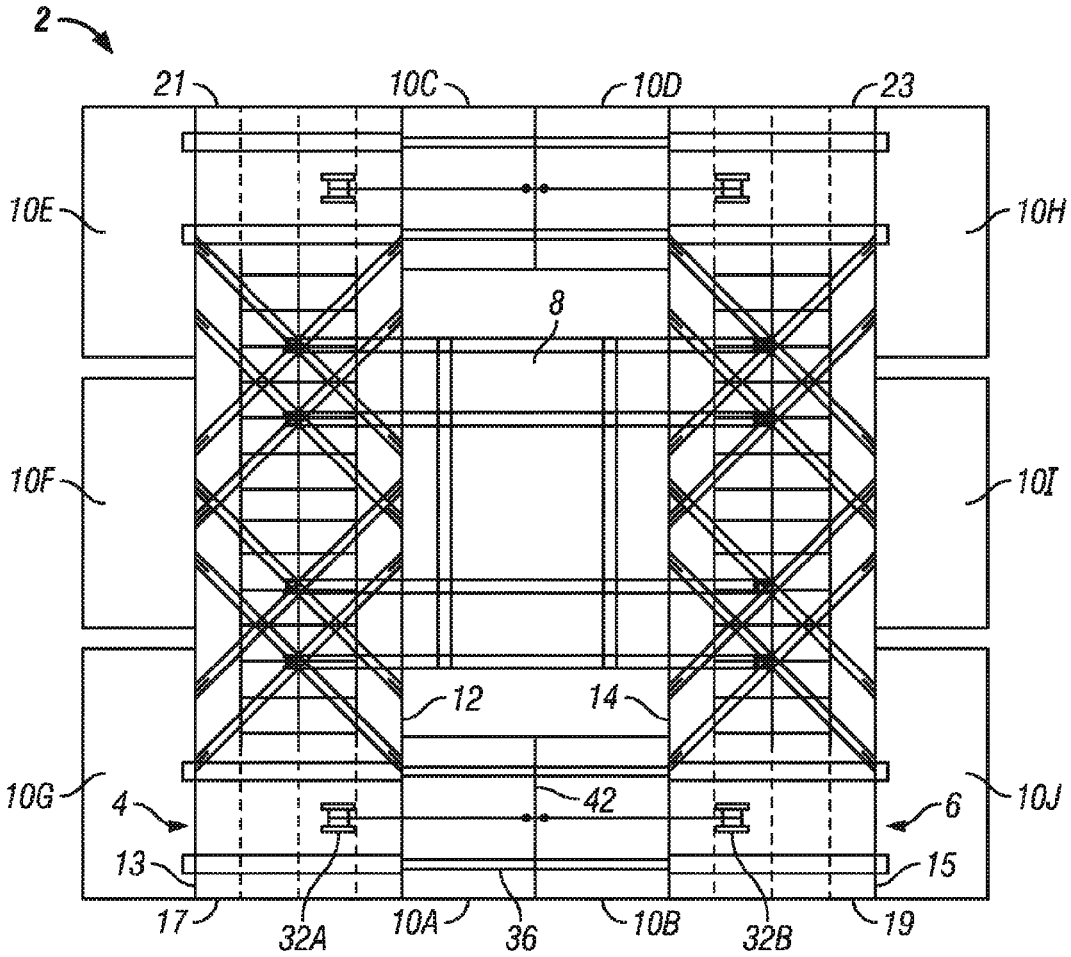
FIG. 19 is a schematic top view of the stabilized catamaran system shown in FIG. 9 having one or more outward heave plates.
Figure 20:
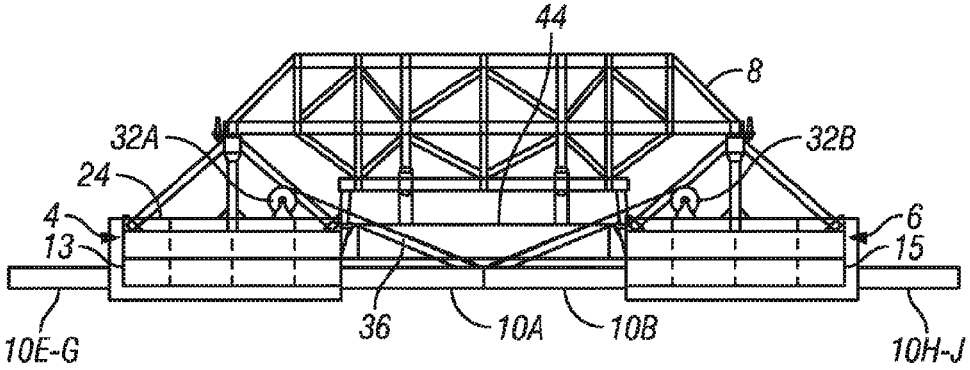
FIG. 20 is a schematic end view of the stabilized catamaran system shown in FIG. 19 with the outward heave plates deployed.
Figure 22:
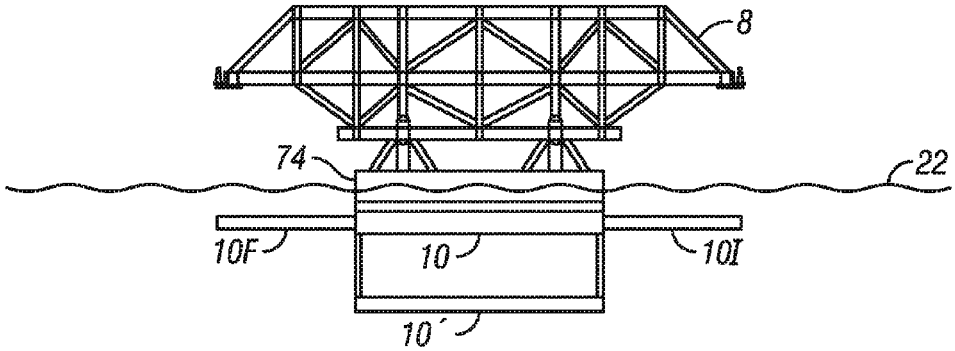
FIG. 22 is a schematic end view of the stabilized system shown in FIG. 21.

FIG. 19 is a schematic top view of the stabilized catamaran system shown in FIG. 9 having one or more outward heave plates. FIG. 20 is a schematic end view of the stabilized catamaran system shown in FIG. 19 with the outward heave plates deployed. The figures will be described in conjunction with each other. Further, some embodiments may include one or more heave plates at other positions on the barges in addition to or in lieu of the above-described inward heave plates between the barges. For example, at least some benefit may be obtained from providing one or more heave plates on the outward side 13 of the barge 4 and/or the outward side 15 of the barge 6. The one or more outward heave plates can be positioned along the entire length of the barge, at various portions of the barge, or split up in the different segments along the length of the barge, as may be desired for the particular operating environment. The heave plates can be in a fixed deployment, such as shown and described above in relation to FIGS. 15-18. Alternatively, they can be rotatable and deployable heave plates, such as shown in FIGS. 7-13. Other embodiments are contemplated. In general, the outward heave plates, such as heave plates 10E-10G on barge 4 and/or 10H-10J on barge 6, can further change the resonance period of the catamaran system 2 and its response to heave. Further, the outward heave plates are not limited to the clearance issues of the inward heave plates on the inward sides 12, 14, as the barges 4, 6 are aligned with the offshore structure 44 shown above. Thus, the outward heave plates 10E-10J can remain deployed with less interference during the installation procedures. After installation, any of the rotatable outward heave plates can be returned to a stowed position, such as a more vertical position, when returning the barges to a fabrication yard or for other further use. Similarly, one or more heave plates can be coupled to one or more ends of the barges, as illustrated in FIGS. 21 and 22 below.

FIG. 21 is a schematic top view of a stabilized system with one barge having one or more heave plates. FIG. 22 is a schematic end view of the stabilized system shown in FIG. 21. The figures will be described in conjunction with each other. The above described concepts for one or more heave plates can also be applied to a single barge system 2'. For example, a single barge 74 can be used to install a topsides 8 onto an offshore structure (not shown). Unlike the catamaran system 2, the single barge system 2' would generally not straddle the offshore structure, but instead would generally install the topsides 2 between two adjacent portions of an offshore structure. Similar issues occur with the different heave movement of the barge 74 compared to relative stable position of the offshore structure. Thus, one or more heave plates can be deployed on the barge to function in a similar manner as has been described above for the two or more barges.

For example, a heave plate 10 can be installed on a stern end 76 at least partially below the water level 22. The heave plate 10 can be coupled to one or more types of support structures 75, such as similar to the support structures 24, 30, 46, 52 described above, can rotate about the support structure or be fixed in position, and can have other appropriate characteristics as has been described with the catamaran system 2 and associated heave plate system herein.

Further, an additional heave plate 10' can be coupled to the system 2' below the heave plate 10, similar to the system described in FIG. 4. One or more additional heave plates 10K can be coupled to a bow end 77 of the barge 74 in a similar manner. Still further, one or more heave plates 10F, 10I can be coupled to one or more of the sides 78, 79 of the barge 74. The heave plates on the sides can also be coupled to one or more types of support structures, can rotate about the support structures or be fixed in position, and have other appropriate characteristics as has been described with the catamaran system 2 and associated heave plate system herein.

Figure 23:
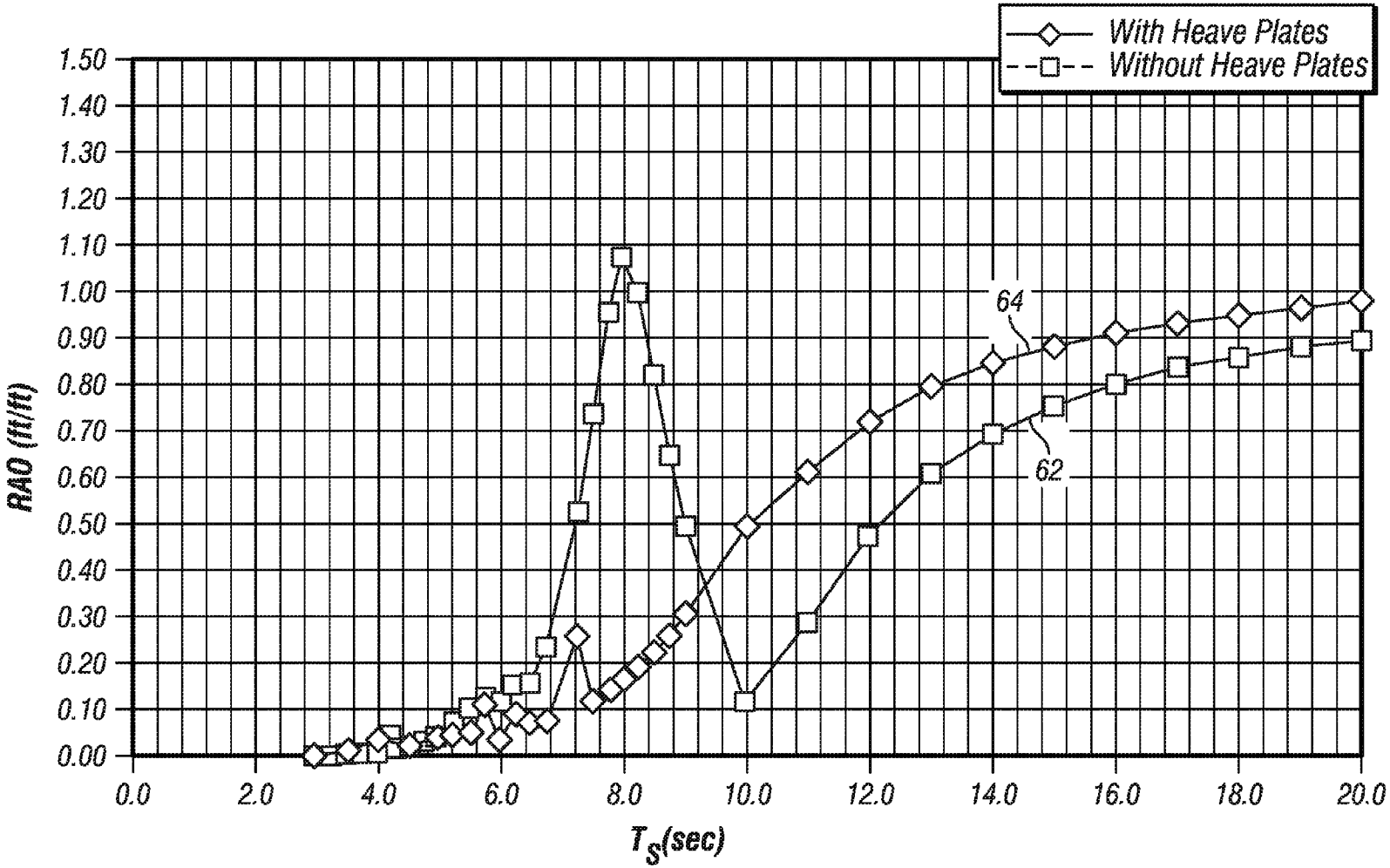
FIG. 23 is a chart of predicted effects of the heave plate on a catamaran system based on a typical design wave period, comparing a stabilized catamaran system with an unstabilized catamaran system.

FIG. 23 is a chart of predicted effects of the heave plate on a catamaran system based on a typical design wave period, comparing a stabilized catamaran system with an unstabilized catamaran system. Curve 62 represents the heave motion of the catamaran system without the stabilization effects of one or more heave plates described above. For typical design criteria of an eight second wave period $T_S$, the heave of the catamaran system can have almost a one-to-one ratio at the maximum movement. The theoretical results based on modelling show that the movement is slightly higher at 1.1 (10% higher) compared to the motion of the waves.

In remarkable contrast, as has been discovered by the inventors, the heave plate can significantly reduce the heave of the catamaran system as shown in the curve 64 with heave plates. The modelling demonstrates that the heave is about 15% compared to the prior 110% at the design wave period of eight seconds. Effectively, the heave plate lengthens the catamaran system period and the resonance of such period, so that the catamaran system movement is dampened at the design period and thus does not move in direct correlation to the wave passing by the catamaran system.

Other and further embodiments utilizing one or more aspects of the inventions described above can be devised without departing from the spirit of Applicant's invention. Further, the various methods and embodiments of the barge system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to fully protect all such modifications and improvements that come within the scope or range of equivalent of the following claims.

What is claimed is:

1. A catamaran system for installing a topsides onto an offshore structure, comprising:

at least two floating barges, each of the floating barges having a top, bottom, and sides; and at least one heave plate rotationally coupled to at least one of the floating barges between a stowed raised position and a deployed position at a location at least partially below a water level adjacent the at least one of the floating barges.

2. The catamaran system of claim 1, wherein the at least one heave plate is located toward a stem of the at least two floating barges and absent from a bow of the at least two floating barges relative to a direction of approach to the offshore structure.

3. The catamaran system of claim 1, further comprising a support structure coupled to at least one of the floating barges and the at least one heave plate hingeably coupled to the support structure.

4. The catamaran system of claim 1, wherein each of the at least two floating barges has at least one heave plate hingeably coupled to an inward side toward a bow end of each of the floating barges and at least one heave plate hingeably coupled to an inward side toward a stem end of each of the floating barges.

5. The catamaran system of claim 1, wherein each of the at least two floating barges have at least one heave plate rotationally coupled to an inward side of each of the floating barges toward each other, so that a barge-to-barge clearance between the heave plates is greater than the offshore structure when the heave plates are in the stowed raised position, but less than the offshore structure when the heave plates are in the deployed position.

6. The catamaran system of claim 1, wherein a second heave plate is coupled below a first heave plate and separated by a distance from the first heave plate.

7. The catamaran system of claim 1, wherein the at least one heave plate is coupled to an outward side of the at least one of the floating barges.

8. A method of stabilizing a catamaran system having at least two floating barges, comprising:

obtaining at least two floating barges with at least one heave plate rotationally coupled to at least one of the floating barges;

installing a topsides on the floating barges;

transporting the topsides to an installation site with the at least one heave plate stowed in a raised position;

rotating the at least one heave plate to a deployed position so that the at least one heave plate is positioned below a water surface adjacent the at least one of the floating barges and extends from the at least one of the floating barges;

positioning the topsides on the offshore structure;

releasing the topsides from the floating barges; and removing the floating barges from the offshore structure.

9. The method of claim 8, further comprising maintaining the at least one heave plate in the raised position until the heave plate passes by the offshore structure between the barges before rotating the heave plate to the deployed position.

10. A catamaran system for installing a topsides onto an offshore structure, comprising:

at least two floating barges, each of the floating barges having a top, bottom, and sides; and each of the floating barges comprises at least one heave plate coupled on an inward side of each of the floating barges and at least one heave plate is removably coupled to at least one of the floating barges at a location at least partially below a water level adjacent the at least one of the floating barges.

11. The catamaran system of claim 10, wherein the at least one heave plate on the inward side on each of the floating barges is coupled together when the at least one heave plate is in a deployed position.

12. The catamaran system of claim 10, wherein the at least one heave plate on each of the floating barges is raised to an upright position when not deployed.

13. A method of stabilizing a catamaran system having at least two floating barges, comprising:

obtaining at least two floating barges with a heave plate removably coupled to a first floating barge and a heave plate coupled to a second floating barge;

installing a topsides on the floating barges;

transporting the topsides to an installation site;

ensuring at least one of the heave plates is positioned below a water surface adjacent at least one of the floating barges and extends from the at least one of the floating barges;

positioning the topsides on the offshore structure;

releasing the topsides from the floating barges;

removing the floating barges from the offshore structure; and releasably coupling the heave plate on the first floating barge with the heave plate on the second floating barge.

14. The method of claim 13, further comprising rotating the heave plates to a deployed position prior to coupling the heave plate on the first floating barge with the heave plate on the second floating barge.

15. The method of claim 13, further comprising releasing the coupling of the heave plate on the first floating barge with the heave plate on the second floating barge after the releasing the topsides from the floating barges.

16. The method of claim 15, wherein removing the floating barges from the offshore structure comprises moving the floating barges laterally away from the offshore structure after releasing the coupling of the heave plate on the first floating barge with the heave plate on the second floating barge.

17. A method of stabilizing a catamaran system having at least two floating barges, comprising:

obtaining at least two floating barges with a heave plate removably installed on at least one of the floating barges;

installing a topsides on the floating barges;

transporting the topsides to an installation site;

ensuring the heave plate is positioned below a water surface adjacent the at least one of the floating barges and extends from the at least one of the floating barges;

positioning the topsides on the offshore structure;

releasing the topsides from the floating barges; and removing the floating barges from the offshore structure, wherein ensuring the heave plate is positioned below the water surface comprises removably coupling the heave plate to a deployed position below the water surface adjacent the at least one of the floating barges.

18. A method of stabilizing a catamaran system having at least two floating barges, comprising:

obtaining at least two floating barges with a heave plate removably installed on at least one of the floating barges;

installing a topsides on the floating barges;

transporting the topsides to an installation site;

ensuring the heave plate is positioned below a water surface adjacent the at least one of the floating barges and extends from the at least one of the floating barges;

positioning the topsides on the offshore structure;

releasing the topsides from the floating barges; and removing the floating barges from the offshore structure, comprising moving the floating barges longitudinally away from the offshore structure after releasing the topsides from the floating barges.

19. The method of claim 18, wherein a heave plate is coupled to a first floating barge and a heave plate is coupled to a second floating barge and the topsides is coupled to the first floating barge and second floating barge.

* * * * *